US005361556A

United States Patent [19]

Menchetti

[11] Patent Number: 5,361,556

[45] Date of Patent: Nov. 8, 1994

[54] HORIZONTAL UNITIZED PANEL

[75] Inventor: Robert J. Menchetti, Buffalo, N.Y.

[73] Assignee: National Gypsum Company, Charlotte, N.C.

[21] Appl. No.: 22,589

[22] Filed: Feb. 25, 1993

[51] Int. Cl.[5] ..... F04B 2/28; F04C 1/00

[52] U.S. Cl. ..... 52/561; 52/271; 52/281; 52/580; 52/601

[58] Field of Search ..... 52/271, 580, 561, 563, 52/564, 565, 566, 568, 582, 583, 585, 579, 595, 281, 282.1, 282.2, 785, 601, 822

[56] References Cited

U.S. PATENT DOCUMENTS

| | | | |
|---|---|---|---|
| 585,111 | 6/1897 | Lehmann . | |
| 2,372,038 | 3/1945 | Westveer . | |
| 2,495,862 | 1/1950 | Osborn . | |
| 2,752,013 | 6/1956 | Cole . | |
| 3,235,039 | 2/1966 | O'Donnell | 52/282.1 |
| 3,312,032 | 4/1967 | Ames | 52/580 |
| 4,047,347 | 9/1977 | Scheid . | |
| 4,125,984 | 11/1978 | Jonas | 52/281 |
| 4,201,020 | 5/1980 | Saunders | 52/580 |
| 4,897,976 | 2/1990 | Williams et al. | 52/281 |
| 5,094,052 | 3/1992 | Gudmundsson et al. | 52/595 |
| 5,129,628 | 7/1992 | Vesper | 52/281 |

*Primary Examiner*—Carl D. Friedman
*Assistant Examiner*—Christopher Todd Kent
*Attorney, Agent, or Firm*—Marshall, O'Toole, Gerstein, Murray & Borun

[57] ABSTRACT

Horizontal panels, each consisting of top and bottom horizontal studs, with gypsum boards affixed therebetween, are stacked vertically, with suitable means for maintaining the wall vertical.

19 Claims, 5 Drawing Sheets

FIG. 4
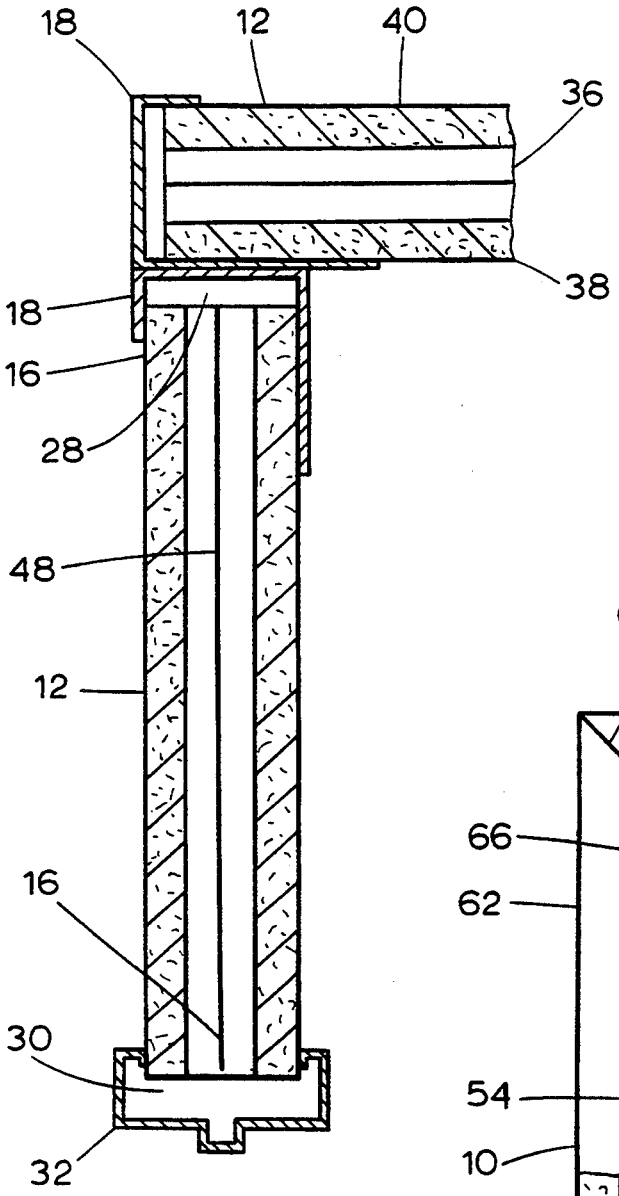
FIG. 5
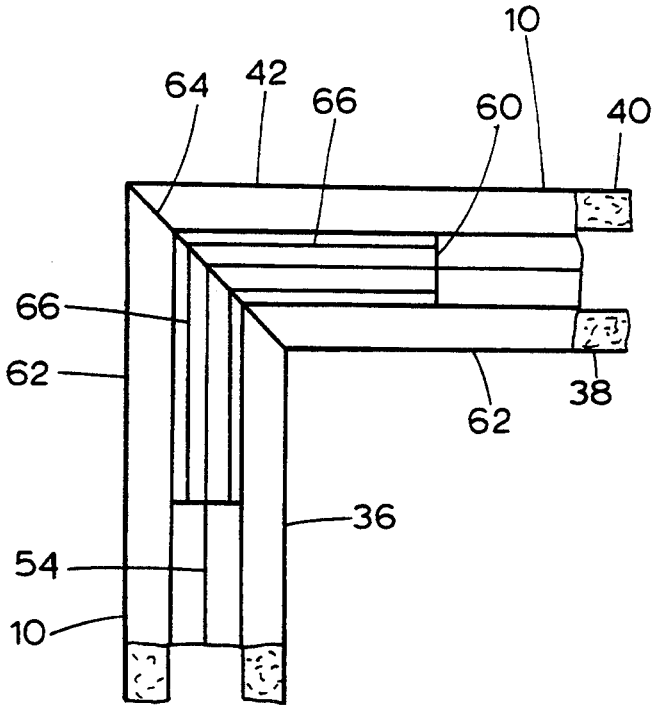
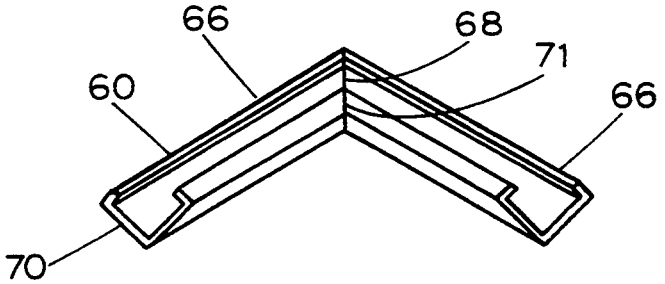
FIG. 6

FIG. 8
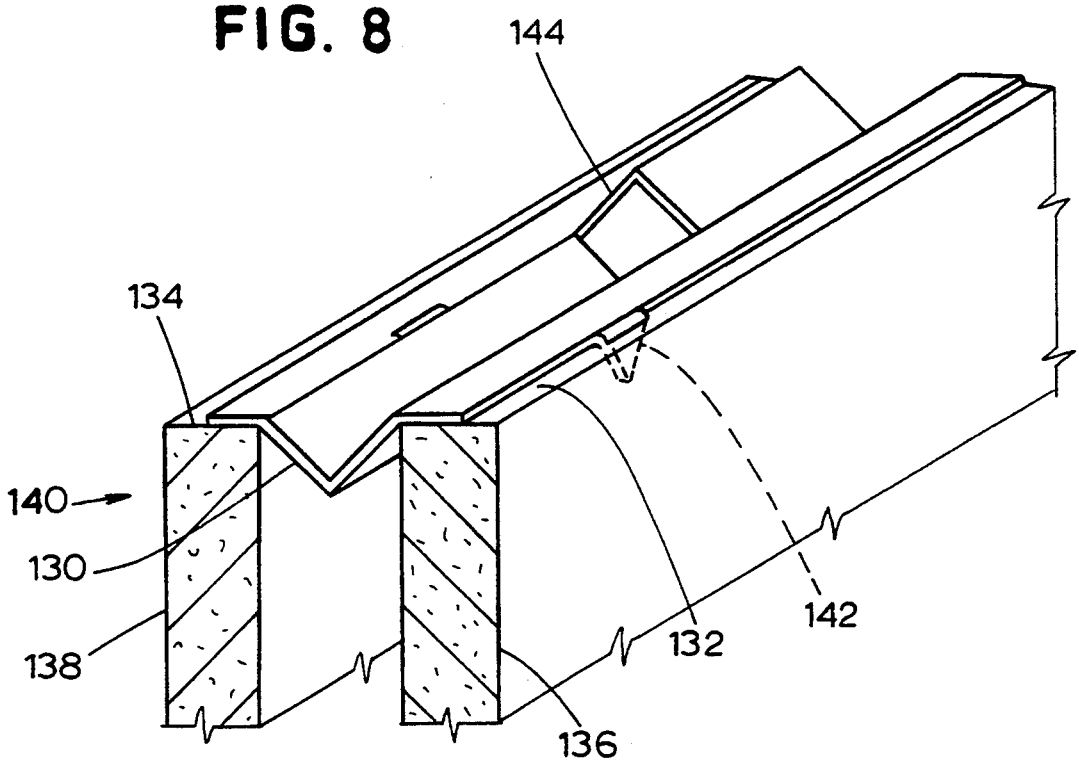
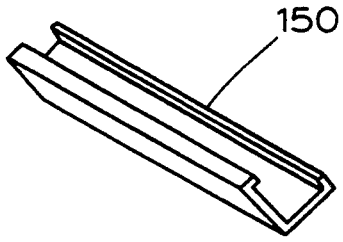
FIG. 9

HORIZONTAL UNITIZED PANEL

This invention relates to walls of elongate horizontal panels, which panels consist essentially of a pair of vertically spaced horizontal studs and a pair of horizontally elongate boards affixed between the studs.

BACKGROUND OF THE INVENTION

A hollow elevator shaft wall was recently developed which is constructed by essentially stacking, alternately, elongate horizontal metal studs and horizontally extending gypsum core boards, and then subsequently affixing gypsum wallboard to the outer faces of the studs in a spaced relation to the core boards. A complete description of this prior wall is set forth in my copending application, Ser. No. 7/858,797, which application is included herein by reference. A comparable wall which can be erected easier and more rapidly is desired.

SUMMARY OF THE INVENTION

The present invention consists of an elongate panel which includes two vertically spaced horizontal studs with a pair of horizontally elongate gypsum boards affixed between the two studs.

In the preferred embodiments, the two gypsum boards are spaced apart horizontally, to form a hollow wall. The horizontal studs are formed with webs which are shaped suitably for interlocking with stud webs of adjacent panels. The gypsum board on at least one side of each panel is affixed to the two horizontal studs in a manner which leaves the outside face of the board completely exposed, suitable for treatment with joint treatment system, to produce a monolithic wall, when two panels are abutted.

It is an object of the invention to provide a novel horizontal wall panel, for use in constructing an improved vertical wall.

It is a further object to provide an improved vertical wall consisting of such novel wall panels.

It is a still further object to provide a novel method of erecting vertical walls.

BRIEF DESCRIPTION OF THE DRAWINGS

These and other objects and advantages of the invention will be more readily apparent when considered in relation to the preferred embodiments as set forth in the specification and shown in the drawings in which:

FIG. 4 is a sectional plan view of a corner of the wall of FIG. 1, plus a door jamb.

FIG. 5 is a sectional plan view of a modified form of corner.

FIG. 6 is an isometric view of the corner key of FIG. 5.

FIG. 8 is an isometric view of the edge of a further modified panel.

FIG. 9 is an isometric view of an optional separate attachment channel that could be used in the walls of FIGS. 2, 7 and 8 in place of the lower stud offset section.

DESCRIPTION OF THE PREFERRED EMBODIMENTS

Figure 1:
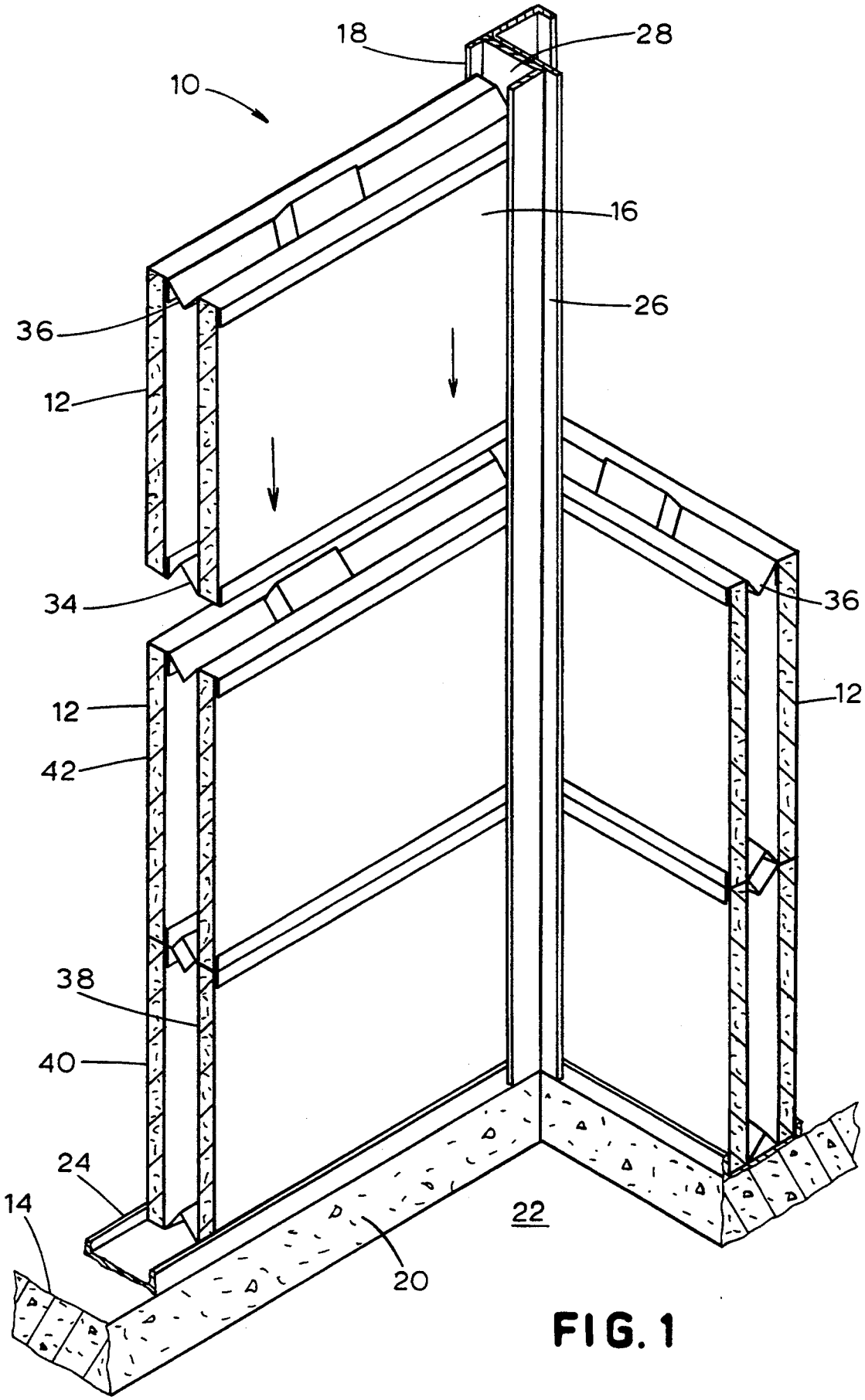
FIG. 1 is an isometric view of a corner section of a shaft wall, adjacent an elevator shaft, which wall embodies the present invention.

Referring to FIG. 1, there is shown a wall 10 consisting of a plurality of horizontal unitized panels 12, mounted atop a concrete floor slab 14, with panel ends 16 extending into a vertical corner post 18. Floor slab 14 is terminated at an edge 20 which surrounds an elevator shaft 22. A J-shaped floor track 24 is affixed to floor slab 14.

The wall 10 is assembled by affixing floor track 24 to floor slab 14, affixing corner post 18 in the floor track 24 at the wall corner 26. Corner post 18 is also affixed at its top to a J-shaped, downwardly opening ceiling track (not shown).

A first panel 12 is then placed on floor track 24 with one end 16 inserted into a channel 28 of corner post 18, and an opposite end 16 inserted into a channel 30 of a door jamb 32, FIG. 4, or a channel 28 of a second corner post 18 (not shown). The length of panel 12 is made short enough so that when one end 16 is all the way into one channel 28 or 30, the other end 16 can be started into the opposite channel 28 or 30. With the two ends 16, 16 each about halfway into a channel 28 or 30, the panel is screw-affixed to the corner posts 18 and/or door jamb 32.

After the first panel 12 is affixed in place, subsequent panels are similarly inserted in channels 28 or 30 and similarly screw-affixed, progressively on top of one another.

Figure 2:
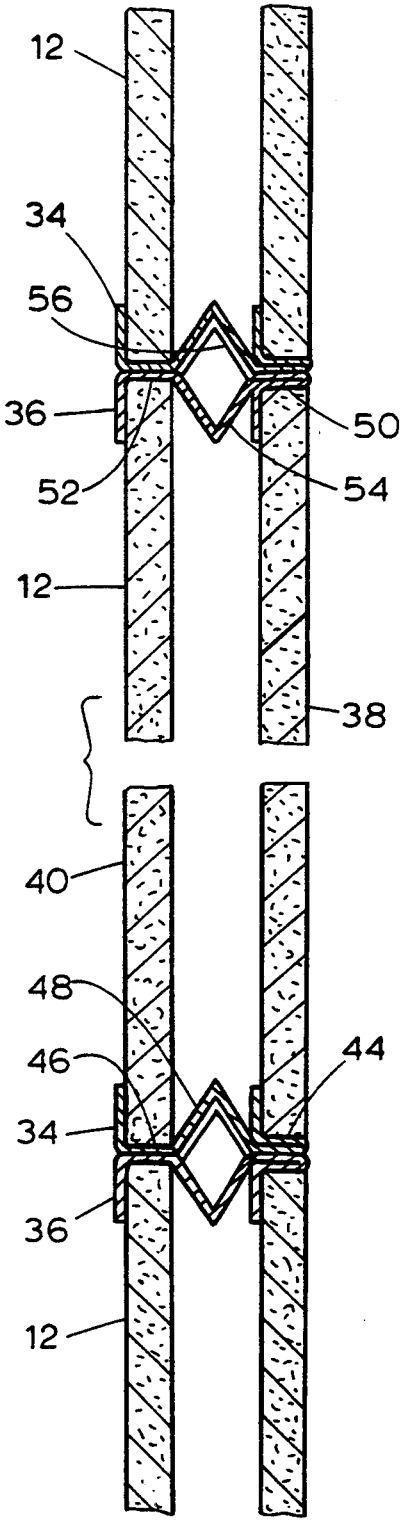
FIG. 2 is a sectional end view of one of the panels of FIG. 1, plus a portion of the two adjacent panels.
Figure 3:
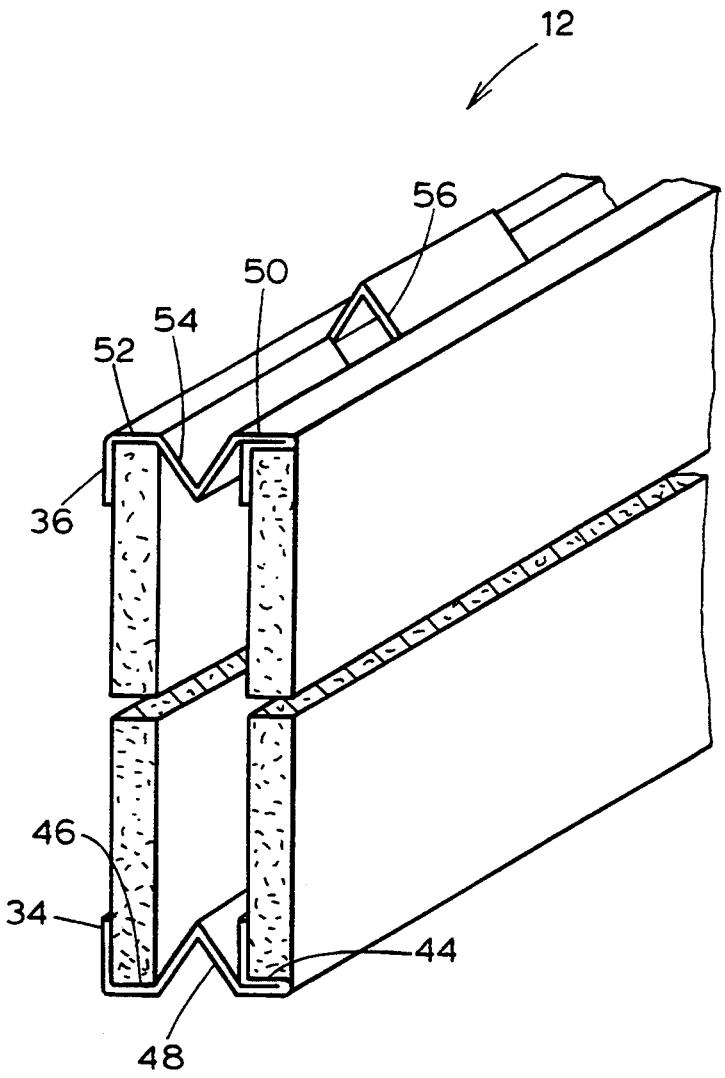
FIG. 3 is an isometric view of one of the panels of FIG. 1.

Referring to FIG. 2, panels 12 are shown stacked one on top of another. Panels 12 consist of a bottom elongate horizontal metal stud 34, a top elongate horizontal stud 36, an inner gypsum board 38 disposed on the elevator shaft side of the wall 10, and an outer gypsum board 40, adapted to form a hallway wall surface 42.

Bottom stud 34 includes an inner L-shaped board edge shelf 44, an outer L-shaped board edge shelf 46 and an upwardly extending, V-shaped web 48 connecting the two L-shaped shelves 44, 46. Top stud 36 includes an inner L-shaped shelf 50, an outer L-shaped shelf 52 and a primarily downwardly extending, V-shaped web 54 connecting the two L-shaped shelves 50, 52.

V-shaped web 54 also includes a plurality of short, upwardly extending, V-shaped portions 56. The upwardly extending, V-shaped portions 56 of web 54 are shaped to fit snugly and nest within a bottom stud web 48 of a panel 12 thereabove. The gypsum boards 38, 40 are each adhesively affixed to the respective L-shaped shelves 44, 46, 50 and 52, forming a completed hollow unitary panel 12. The boards may, alternatively, be screw-affixed to the studs. The boards 38, 40 are affixed to the top of shelves 44, 46 of the bottom stud 34 and to the bottom of shelves 50, 52 of the top stud 36, and the weight of each board 38 or 40 is supported by an immediately lower board 38 or 40, transmitted through the abutting shelves 44, 46, 50, 52.

Referring to FIGS. 5 and 6, a corner key 60 is shown connecting two perpendicular walls 10, which have panels 62, similar to panels 12, except with a mitered end 64. Corner key 60 consists of two perpendicular legs 66 adjoined at a mitered corner 68. Each leg 66 has a partial-diamond shaped cross section, and is adjoined at corner 68 by being formed with one lower, outer wall 70 being continuous with a fold 71 at the corner 68.

Alternatively, the two legs 66 could be welded together. The partial-diamond shaped cross section has a size and shape which fits snugly between the webs 48, 54 of two studs 34, 36.

By employing a corner key 60 at the junction of each pair of studs 34, 36 with similar studs 34, 36 of a perpendicular wall 10, no corner post is needed, and, of significance, the outer wallboards are more completely exposed, for forming a mono-lithic-appearing, joint-treated hall surface 42.

Figure 7:
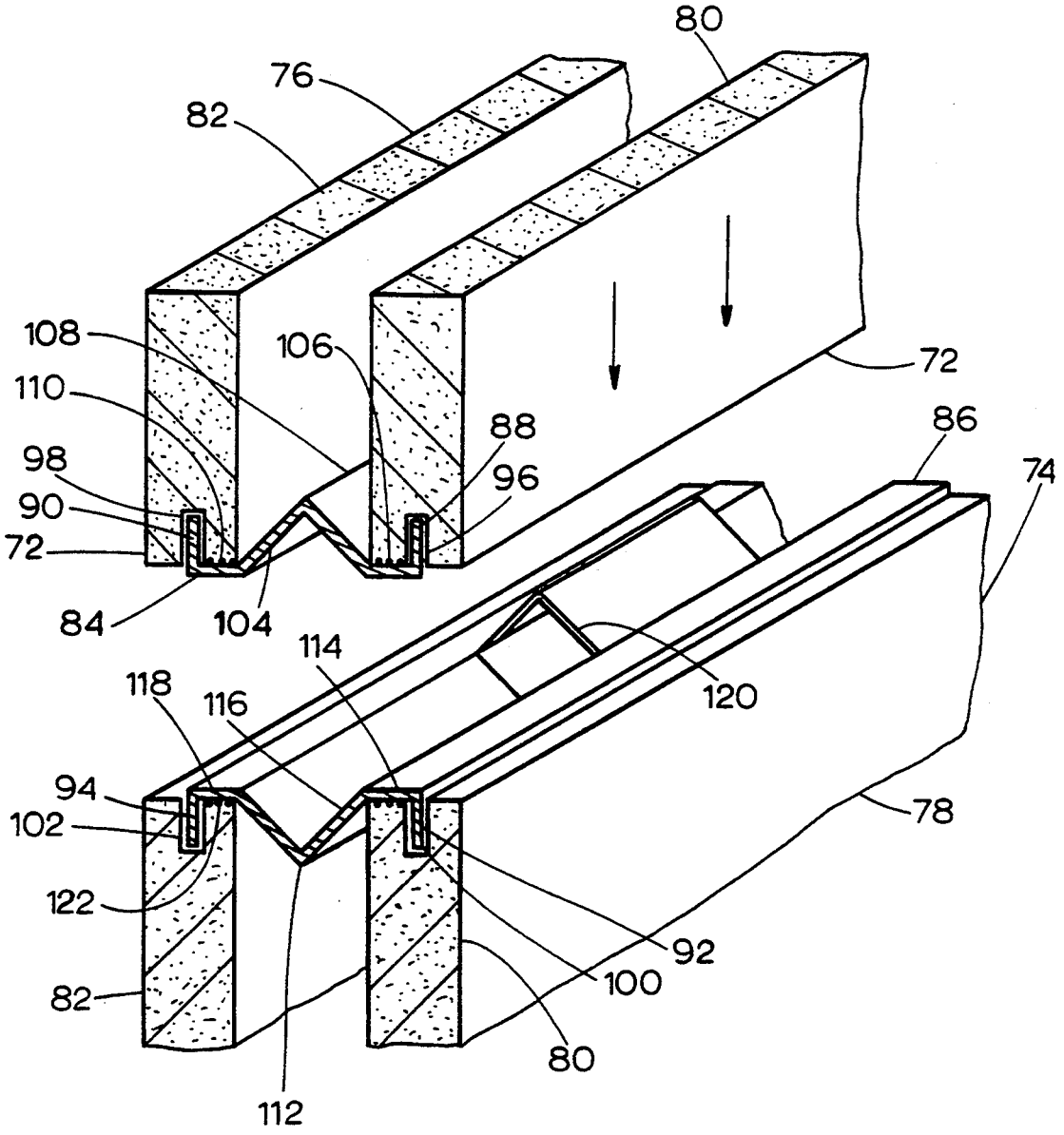
FIG. 7 is an isometric view of the edges of two modified panels being mounted together.

Referring to FIG. 7, the bottom 72 and the top 74 of respectively two panels 76, 78 of a modified form are shown. Panels 76 and 78 each have a bottom 72 and a top 74, whereat the gypsum boards 80, 82 are adjoined by horizontal studs 84, 86, each of which have flanges 88, 90, 92, 94 which fit snugly within elongate kerfs 96, 98, 100, 102 formed in the edges of boards 80, 82.

Stud 84 on panel bottom 72 includes a web 104 which has an inner land section 106, an upwardly extending, V-shaped web center section 108 and outer land section 110. Stud 86 on panel top 74 includes a web 112 which has an inner land section 114, a primarily downwardly extending, V-shaped web center section 116 and outer land section 118.

Web center section 116 also includes a plurality of short, upwardly extending, V-shaped nesting portions 120, shaped to fit snugly within the V-shaped web center section 108 of stud 84.

Studs 84, 86 can be more firmly affixed to boards 80, 82 by using an adhesive 122 on each of the land sections 106, 110, 114 and 118.

Referring to FIG. 8, a horizontal stud 130 is shown affixed to the top edges 132, 134 of gypsum boards 136, 138 to form a panel 140 which is similar to panel 76, 78 of FIG. 7, except that stud 130 has impaling points 142 forced into edges 132, 134, in place of flanges 88, 90, 92, 94 in kerfs 96, 98, 100, 102.

FIG. 9 shows an optional, short, separate attachment channel 150, having a partial-diamond shaped cross section, which may be placed in between vertically adjacent panels, in place of or in addition to the short, upwardly extending, V-shaped portions 56, 120, 144 of top studs 36, 84 and 130, to maintain alignment of the panels 12, 76, 78 and 140.

Having completed a detailed disclosure of the preferred embodiments of my invention so that those skilled in the art may practice the same, I contemplate that variations may be made without departing from the essence of the invention or the scope of the appended claims.

I claim:

1. A vertical wall comprising a plurality of horizontally elongate, utilized vertically stacked, substantially identical panels including at least one lower panel and at least one upper panel, each of said panels having a horizontal bottom stud, a horizontal top stud and at least two boards, each of said studs comprising two parallel elongate side sections and a central web between and connecting said side sections, said web including offset nesting means, said boards each having a top edge and a bottom edge, said bottom edges of said boards of said upper panel being affixed to a top of a side section of a bottom stud and said top edges of said boards of said lower panel being affixed to a bottom of a side section of a top stud, said side sections extending between and being attached to said top edges and said bottom edges, said side sections extending between adjacent edges of said upper and lower panels whereby said boards of said upper panel are supported by said boards of said lower panel and the weight of said boards of said upper panel are transmitted through said side sections to said boards of lower panel.

2. A vertical wall as defined in claim 1, and further comprising means for maintaining said stacked panels vertically aligned comprising a fixed vertical post having a vertical channel with said panels extending into said channel.

3. A vertical wall as defined in claim 2, wherein said means for maintaining said stacked panels vertically aligned comprises a plurality of corner clips affixed to ends of horizontal studs in a pair of angularly directed vertical walls.

4. A vertical wall as defined in claim 1, wherein said side section on at least one side of said wall is terminated between said boards whereby a joint is formed between said upper and said lower panels suitable for a wallboard joint treatment concealing said joint.

5. A vertical wall as defined in claim 1, wherein said elongate side sections are L-shaped shelves to which said boards are affixed.

6. A vertical wall as defined in claim 1, wherein said elongate side sections each include a vertically directed flange extending into an elongate kerf in an edge of one of said boards.

7. A vertical wall as defined in claim 1, wherein said elongate side sections each include vertically directed impaling points extending into an elongate edge of one of said boards.

8. A vertical wall as defined in claim 1, wherein said two boards are spaced apart, forming a hollow panel.

9. A vertical wall as defined in claim 8, wherein said wall is adjacent an edge of an elevator shaft.

10. A vertical wall as set forth in claim 1, wherein said offset nesting means comprise mating offset web portions having slanted walls.

11. A vertical wall as set forth in claim 10, wherein said mating slanted walls have a V-shape.

12. A horizontal wall panel for use with a second substantially identical wall panel, comprising upper and lower spaced, elongate, horizontal, sheet metal studs and at least two elongate horizontal boards, each of said studs including two parallel side abutting portions and a central web portion connecting said side abutting portions, each of said boards having a lower elongate edge resting on an abutting portion of said lower stud and an upper edge supporting an abutting portion of said upper stud, said central web section of said upper stud having an offset portion suitable for nesting with said central web portion of said lower stud of said second identical panel with the weight of said boards being transmitted directly through abutting portions of said studs.

13. A panel as defined in claim 12, wherein said two elongate horizontal boards are spaced apart.

14. A panel as defined in claim 12, wherein said offset portion of said upper stud comprises an upwardly extending, V-shaped portion, and said central web of said lower stud having a complementary, upwardly extending V-shaped portion.

15. A method of constructing a vertical wall comprising forming horizontal unitized substantially identical panels having an elongate metal horizontal lower stud, an elongate metal horizontal upper stud and two boards, each of said boards having end edges abutting a top of said lower stud and a bottom of said upper stud, said end edges of said boards engaging said lower and upper studs, affixing said studs to said end edges of said boards to form a unitized panel, forming substantially identical nesting portions on said lower and upper studs, and stacking said panels to form a vertical wall.

16. The method of claim 15, wherein said boards are gypsum boards and comprising adhesively affixing said boards to said studs to unitize said panels.

17. The method of claim 15, wherein said boards are gypsum boards and comprising inserting vertically extending portions of said studs into said boards to unitize said panels.

18. The method of claim 15, further comprising maintaining vertical alignment of said wall by inserting ends of said panels into an elongate vertical channel of a fixed vertical post.

19. The method of claim 15, further comprising adjoining said vertical wall to a similar vertical wall extending at an angle therefrom, connecting ends of said horizontal studs of one wall to ends of said horizontal studs of said similar wall with angled corner clips.

* * * * *

UNITED STATES PATENT AND TRADEMARK OFFICE

CERTIFICATE OF CORRECTION

PATENT NO. : 5,361,556

DATED : November 8, 1994

INVENTOR(S) : Robert J. MENCHETTI

It is certified that error appears in the above-identified patent and that said Letters Patent is hereby corrected as shown below:

Column 3, line 53, between the words "elongate," and "vertically", the word "utilized" should be --unitized--.

Signed and Sealed this

Third Day of January, 1995

Bruce Lehman

*Attest:*

BRUCE LEHMAN

*Attesting Officer*

*Commissioner of Patents and Trademarks*